US006072269A

United States Patent [19]

Takeuchi et al.

[11] Patent Number: 6,072,269

[45] Date of Patent: Jun. 6, 2000

[54] CERAMIC MEMBER WITH AN ELECTRODE AND A PLURALITY OF TAPERED THROUGH HOLES FOR CONTROLLING THE EJECTION OF PARTICLES BY SWITCHING THE SIGN OF A CHARGE ON THE ELECTRODE

[75] Inventors: Yukihisa Takeuchi, Nishikamo-gun; Tsutomu Nanataki, Toyoake; Hisanori Yamamoto, Nagoya; Takashi Oguchi, Okaya, all of Japan

[73] Assignee: NGK Insulators, Ltd., Nagoya, Japan

[21] Appl. No.: 08/892,889

[22] Filed: Jul. 15, 1997

[30] Foreign Application Priority Data

Jul. 23, 1996 [JP] Japan ..... 8-193096

[51] Int. Cl.[7] ..... H01J 1/46; H05H 1/00

[52] U.S. Cl. ..... 313/348; 313/420; 313/360.1; 313/336; 347/127

[58] Field of Search ..... 313/348, 349, 313/309, 351, 336, 420, 363.1, 230, 360.1, 361.1; 347/127

[56] References Cited

U.S. PATENT DOCUMENTS

| | | | |
|---|---|---|---|
| 5,278,588 | 1/1994 | Kubelik | 346/159 |
| 5,512,793 | 4/1996 | Takeuchi et al. | 310/328 |
| 5,517,076 | 5/1996 | Takeuchi et al. | 310/358 |
| 5,600,197 | 2/1997 | Takeuchi et al. | 310/328 |
| 5,728,244 | 3/1998 | Nanataki | 156/89 |
| 5,814,924 | 9/1998 | Komatsu | 313/336 |
| 5,854,490 | 12/1998 | Ooaech et al. | 313/336 |

FOREIGN PATENT DOCUMENTS

| | | | |
|---|---|---|---|
| 0 720 072 A2 | 7/1996 | European Pat. Off. | G03G 17/00 |
| 0 744 388 A1 | 11/1996 | European Pat. Off. | C04B 35/486 |
| 0 744 389 A1 | 11/1996 | European Pat. Off. | C04B 35/486 |
| 2 309 007 | 7/1997 | United Kingdom | B32B 18/00 |
| WO 87/02452 | 4/1987 | WIPO | G01D 15/06 |

OTHER PUBLICATIONS

Mr. M. Miura et al.—The 4th International Congress in Non–Impact Printing Technology, 1987 (p77–p80). (Development in the Air Assisted Electrostatic Inkjet Printer: M. Miura, Y. Itoh, T. Iwasawa, G. Oda, K. Akami, Y. Sekiguchi, Matsushita Research Institute Tokyo, Inc.).

*Primary Examiner*—Michael H. Day
*Assistant Examiner*—Joseph Williams
*Attorney, Agent, or Firm*—Wall Marjama Bilinski & Burr

[57] ABSTRACT

A ceramic member has a flat or curved ceramic plate having a plurality of minute through holes of a maximum pore diameter of 150 $\mu$m or less, and having electrodes installed on one surface of the plate. The ceramic member controls the ejection of ions carrying either positive or negative charge from the minute through holes by switching the sign of charge carried by the electrodes. The minute through holes are tapered toward the side where ions are ejected. The ceramic member gives an improved property of ejecting charged particle from minute through holes while maintaining high mechanical strength and productivity.

6 Claims, 2 Drawing Sheets

CERAMIC MEMBER WITH AN ELECTRODE AND A PLURALITY OF TAPERED THROUGH HOLES FOR CONTROLLING THE EJECTION OF PARTICLES BY SWITCHING THE SIGN OF A CHARGE ON THE ELECTRODE

BACKGROUND OF THE INVENTION AND RELATED ART STATEMENT

The present invention relates to a ceramic member with electrodes used in ion flow control heads, encoders, scales, and high-precision electric field shutters.

A ceramic member comprising a flat plate having a plurality of minute through holes and having electrodes installed on one surface has been used in location detecting devices or recording devices as the part of ion flow control heads, encoders, scales, and high-precision electric field shutters.

An example of such a ceramic member used as part of an ion flow control head is shown in FIG. 3. As shown in FIG. 3, a ceramic member 7 has an electrode 1 provided on one surface. An ion source 5 is installed on the side opposite the surface on which the electrode 1 is provided. The ceramic member 7 controls the ejection of ions 2 to a dielectric drum 3 by switching the sign of charge carried by the electrode 1, so that the ejection of ions 2 through the minute through holes 4 is inhibited by making the electrode 1 carry a charge the same as that of the ions. By contrast, the ejection of ions is accelerated by making the electrode 1 carry a charge opposite that the ions carry. A rigid plate 9 supports the ceramic member 7 an ion flow control head 10, a line electrode 11, and a finger electrode 12.

However, since conventional ceramic members 7 have minute through holes 4 which have a constant area throughout the thickness direction of the ceramic member 7, the large resistance of passing particles results in poor ejection of particles, and the straight motion of particles is inhibited due to the collision of particles with the internal walls of the minute through holes.

To decrease the resistance of passing particles, the reduction of the thickness of the ceramic member has been one proposed solution. In this case, however, the manufacturing process becomes difficult, the mechanical strength of the ceramic member lowers, and the ceramic member may be damaged when minute through holes are formed.

Furthermore, when the above ceramic member 7 is used in an ion flow control head, since a dielectric drum 3 is installed on the side of the surface where the electrode 1 is provided, when the dielectric drum 3 is in close contact with the ceramic member 7, the electrode 1 becomes worn out due to the rotation of the dielectric drum 3.

Therefore, it is an object of the present invention to provide a ceramic member allowing for improved ejection of charged particles from the minute through holes, while maintaining high mechanical strength and good production efficiency. It is a further object of the present invention to provide a ceramic member having electrodes which do not wear out even if the drum is in close contact with the ceramic member.

SUMMARY OF THE INVENTION

According to the present invention, there is provided a ceramic member comprising a flat or curved ceramic plate having a plurality of minute through holes of a maximum pore diameter of 150 μm or less, and having electrodes installed on one surface thereof, wherein the ceramic member controls the ejection of particles having either positive or negative charge from the minute through holes by switching the sign of the charge carried by the electrodes, and the minute through holes have a tapered shape expanding toward the side where the particles are ejected.

In the ceramic member of the present invention, the average taper angle of the minute through holes is preferably between 5 and 45 degrees.

Here, the average taper angle of the minute through holes is defined by the following equation:

$$\text{Average taper angle} = \tan^{-1}\left[(\text{Radius of great circle} - \text{Radius of small circle})/\text{Thickness of substrate}\right]$$

In case the ceramic member of the present invention is used for a dielectric drum, rubber rollers, and the like, it is preferred that the electrodes are installed on a surface opposite to the side that requires adhesion.

BRIEF DESCRIPTION OF THE DRAWINGS

FIG. 2(*b*) is a sectional view both showing another embodiment of an ion flow control head using the ceramic member of the present invention.

PREFERRED EMBODIMENTS OF THE INVENTION

Figure 1:
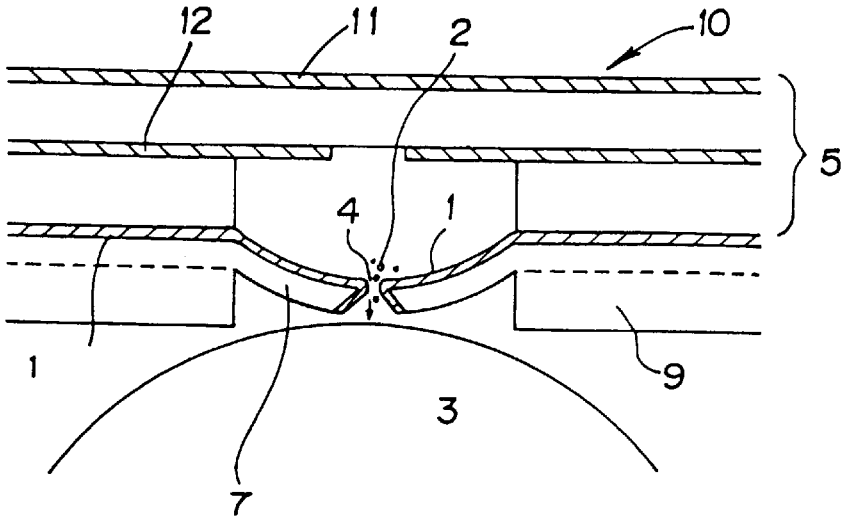
FIG. 1 is a sectional view illustrating an embodiment of an ion flow control head using the ceramic member of the present invention.

The ceramic member of the present invention has tapered minute through holes expanding toward the side of the surface where particles are ejected to allow for the ejection of particles to be improved since the resistance of passing particles is smaller than that of conventional ceramic members in which the taper angle of through holes is zero degrees. Although the particles here are liquids, gases, ions, light, or solids, the effect on solid particles is significant.

In the present invention, the ejection of particles is not so improved when the average taper angle of the minute through holes is less than 5 degrees, and the ejection of particles is no longer improved when the angle exceeds 45 degrees. Moreover, by making the taper angle less than 5 degrees or greater than 45 degrees, the mechanical strength of the tapered part of the through holes will be decreased.

The shape of the openings of the minute through holes is not limited to a specific shape, but may be circular, oval, rectangular, polygonal, or the combination thereof. The pore diameter of the openings is preferably 150 μm or less, preferably between 10 and 150 μm, and more preferably between 30 and 100 μm. This is because when the pore diameter of the minute through holes is larger than 150 μm, the density of the through holes cannot be increased. In addition, if the pore diameter is smaller than 10 μm, the ejection of particles will be difficult. The term "pore diameter" used herein is the diameter when the shape of the minute through holes is circular, the length of the major axis when it is oval, the length of the longer side when it is rectangular, and the length of the longest diagonal line when it is polygonal.

The ceramic member of the present invention has a thickness of preferably between 1 and 50 μm, and more preferably between 10 and 40 μm. If the thickness of the ceramic member is smaller than 1 μm, its mechanical strength decreases, and damage may occur when particles pass through the minute through holes. If the thickness exceeds 50 μm, the resistance of passing particles increases, and the response is deteriorated due to increased passing time in the minute through holes.

Also in the ceramic member of the present invention, it is preferred that the electrodes are formed on the surface opposite the surface that requires adhesion of the minute through holes with the dielectric drum and the like. This is for preventing the wear of the electrodes due to the rotation of the drum when the ceramic member is used, for example, in an electric field shutter and an ion flow control head.

Although the materials of the ceramic member of the present invention may be alumina, completely stabilized zirconia, partly stabilized zirconia, or the mixture thereof, it is preferred, from the point of view of improving the strength and wear resistance of the ceramic member, and of giving adequate Young's modulus, that the ceramic member is based on partly stabilized zirconia containing 2–6 mole percent, preferably 2.5–4.0 mole percent of yttrium oxide, and the average grain diameter of its crystals is 2 μm or less, and preferably 1 μm or less. It is also preferred, from the point of view of controlling Young's modulus and sintering properties, that up to 30 percent by weight of one or more additives such as alumina, silica, clay, magnesia, or transition metals.

The ceramic member of the present invention can be produced for example using the following method.

Ceramic green sheets having a desired thickness are formed using slurry or paste prepared by combining a suitable binder, plasticizer, dispersing agent, sintering additive, and organic solvent to ceramic powder, by a known method such as doctor blade, calendar, printing, and reverse roll coater methods.

The green sheets are then processed by cutting, machining, punching, and the formation of minute through holes to fabricate formed articles having desired shapes and dimensions. The minute through holes are formed by methods such as die/NC punching and excimer laser processing. When the ceramic member is supported by a rigid plate, the ceramic member may be joined to the rigid plate by heating and compressing before the formation of minute through holes.

The system formed above is sintered at a temperature between about 1200 and 1700° C., preferably between about 1300 and 1600° C. If the system is warped after sintering, it is corrected by placing a flat ceramic weight on it and firing it again at a temperature near the sintering temperature. The electrode is formed by printing, spattering, or plating, and the system is patterned by photolithography, excimer laser processing, or etching.

Although it is preferred that no undulations or protrusions are present from the point of view of adhesion, such undulations or protrusions may be removed by etching, grinding, or machining.

FIG. 1 shows an embodiment of an ion flow control head using the ceramic member of the present invention. In the ion flow control head 10 in FIG. 1, an ion source 5 is installed on one side of the ceramic member 7, and a dielectric drum 3 is installed through a rigid plate 9 on the other side. Minute through holes 4 have a shape expanding from the side where the ion source 5 is installed toward the side where the drum 3 is installed, and the electrode 1 is formed on the side opposite to the dielectric drum 3 to which adhesion is required. In this embodiment, the ceramic member 7 is a ceramic member having a shape bent downward in the diagram.

In the ion flow control head 10, the ejection of ions 2 onto the dielectric drum 3 is controlled by switching the sign of charge carried by the electrode 1, so that the ejection of ions 2 from the minute through holes 4 is inhibited by making the electrode 1 carry a charge of the same sign as the ions carry, or accelerated by making the electrode 1 carry a charge of the opposite sign to that the ions carry.

The thickness of the rigid plate 9 is preferably 50 μm or more, and more preferably 100 μm or more. This is because if the thickness of the rigid plate 9 is less than 50 μm, a sufficient mechanical strength cannot be given to the ion flow control head 10.

Figure 2:
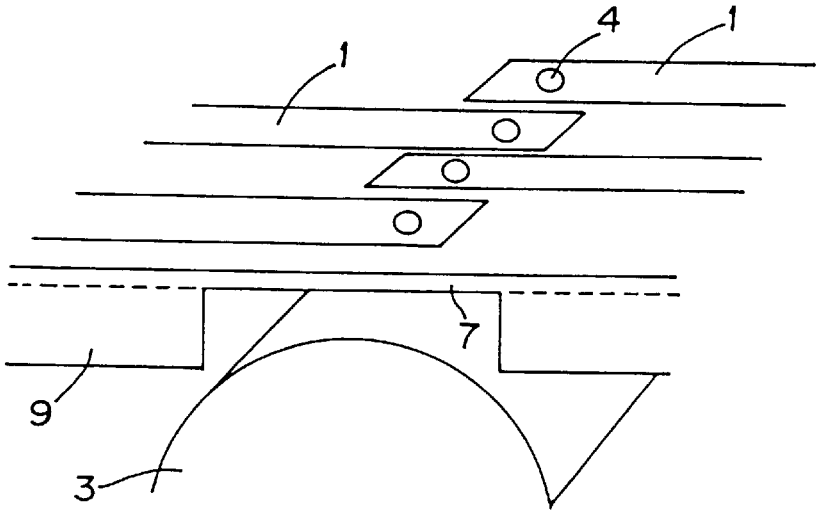
FIG. 2(*a*) is a perspective view.
Figure 2:
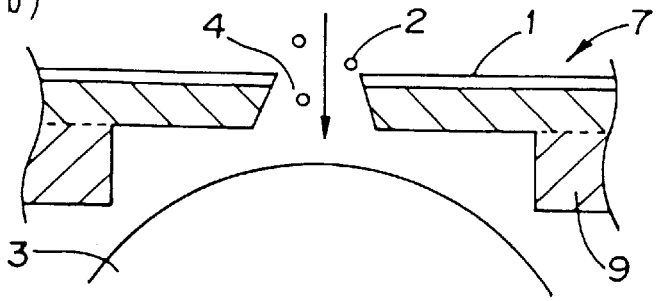
Figure 3:
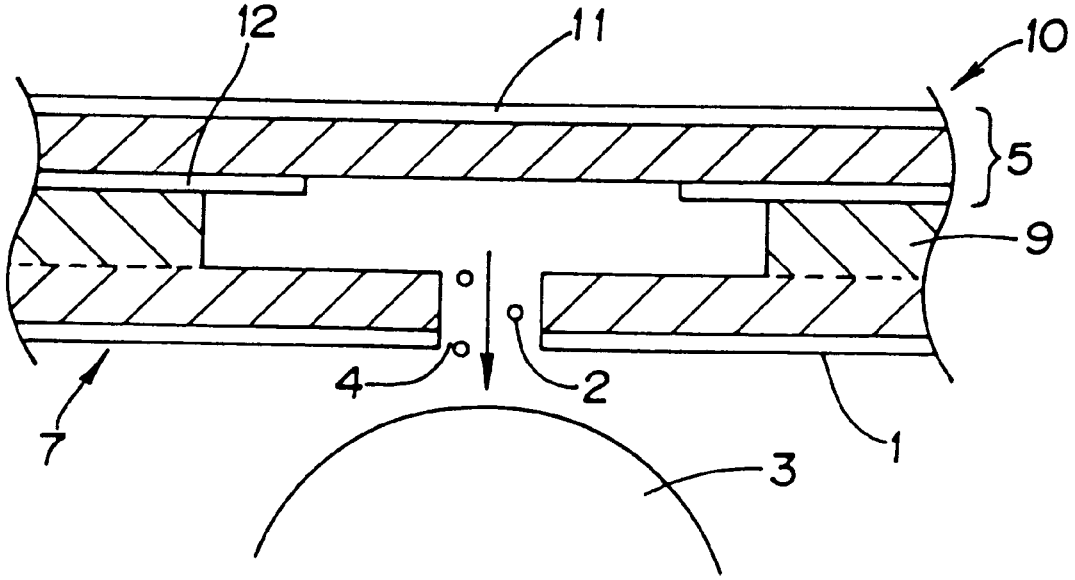
FIG. 3 is a sectional view illustrating an embodiment of an ion flow control head using a prior art ceramic member.

FIGS. 2(*a*) and 2(*b*) show another embodiment of an ion flow control head using the ceramic member of the present invention. In the ion flow control head 10 in FIGS. 2(*a*) and 2(*b*), the ceramic member 7 is supported by a rigid plate 9 at one surface similar to the embodiment of FIG. 1, and the dielectric drum 3 to which ions 2 are deposited is installed on the same side of the rigid plate 9. Also, the electrode 1 is formed on the side opposite to the side where the dielectric drum 3 is installed. Minute through holes 4 have a shape expanding toward the side where the dielectric drum 3 is installed, that is the side where the ions 2 are ejected. In this embodiment a ceramic member 7 with a flat shape is shown.

Although the present invention will be described in detail referring to a preferred embodiment, the present invention is not limited to this embodiment.

EXAMPLE 1

A ceramic member of which minute through holes have a tapered shape expanding toward the surface of the side where particles are ejected was formed, and using this ceramic member, an ion flow control head as shown in FIGS. 2(*a*) and 2(*b*) was fabricated.

The thickness of the ceramic member 7 was 30 μm, and of openings of the minute through holes 4, the smaller pore diameter was 75 μm and the larger pore diameter was 85 μm. The distance between the minute through holes 4 was 80 μm. Here, the distance between the minute through holes means the shortest distance between the edges of adjacent openings with the larger pore diameter. Two rigid plates 9 with a thickness of 80 μm were used, and the width of the area of the ceramic member 7 supported by the rigid plates 9 was 3.0 mm. A ceramic material containing zirconia partially stabilized by 3 mole percent of yttrium oxide, and 0.3 percent by weight of alumina was used as the main component of the ceramic member and the rigid plate. In this case, the taper angle of the minute through holes 4 was $\tan^{-1}[\{(85-75)/2\}/30]=9.5$ degrees.

When this ion flow control head was used for ion transfer, the ejection of particles was improved over the case where the minute through holes are not tapered.

In the ceramic member of the present invention, since the minute through holes have a tapered shape expanding toward the surface of the side where the particles are ejected, the resistance of passing particles is small, and the ejection of the particles is improved, thus preventing defective transfer when the ceramic member is used in a high-precision electric field shutter and an ion flow control head.

Also, since the electrode is formed on the side opposite to the surface that requires adhesion with the drum and the like, the wear of the electrode is prevented when the ceramic member is used in an ion flow control head and a high-precision electric field shutter even if the drum is in close contact with the ceramic member.

What is claimed is:

1. A ceramic member comprising:

a ceramic plate having a plurality of through holes passing therethrough, each hole having a maximum size of 150 $\mu$m or less;

electrodes positioned on at least one surface of said ceramic plate; and means for decreasing the resistance particles encounter when flowing through said through holes, comprising a tapered inner surface provided in each said through hole, said inner surface being tapered outwardly toward the side of said ceramic plate where the particles are ejected;

wherein the ceramic member controls ejection of charged particles through said through holes by changing the sign of the charge carried by said electrodes.

2. The ceramic member of claim 1, wherein said ceramic plate is substantially flat.

3. The ceramic member of claim 1, wherein said ceramic plate is substantially curved.

4. The ceramic member of claim 1, wherein the average taper angle of said through holes is between 5 and 45 degrees.

5. The ceramic member of claim 1, wherein said electrodes are installed on a side of said ceramic plate opposite the side from which particles are ejected.

6. The ceramic member of claim 4, wherein said electrodes are installed on a side of said ceramic plate opposite the side from which particles are ejected.

* * * * *